United States Patent [19]

Prescott

[11] 4,185,426

[45] Jan. 29, 1980

[54] EXTENSION/ELEVATION INTRA-ACTION DEVICE FOR AERIAL LIFT APPARATUS

[75] Inventor: William A. Prescott, Savannah, Mo.

[73] Assignee: A-T-O Inc., Willoughby, Ohio

[21] Appl. No.: 873,516

[22] Filed: Jan. 30, 1978

[51] Int. Cl.[2] ..... E04H 12/34

[52] U.S. Cl. ..... 52/115; 52/118; 182/19; 182/141

[58] Field of Search ..... 52/115, 118, 119; 182/18, 19, 141, 2; 212/8 R, 8 A; 214/141

[56] References Cited

U.S. PATENT DOCUMENTS

| | | | |
|---|---|---|---|
| 2,548,038 | 4/1951 | Moliskey | 212/8 R |
| 2,771,197 | 11/1956 | Leffler | 212/8 R |
| 3,231,044 | 1/1966 | Myers | 182/141 |
| 3,845,596 | 11/1974 | Veenstra | 52/118 |
| 4,070,807 | 1/1978 | Smith, Jr. | 52/119 X |

*Primary Examiner*—Carl D. Friedman

*Attorney, Agent, or Firm*—Dressler, Goldsmith, Clement, Gordon & Shore, Ltd.

[57] ABSTRACT

A telescoping boom lift apparatus having a first boom mounted about a first substantially fixed horizontal pivot axis in a mobile base for vertically pivotable movement with respect thereto and further having a second boom member carried by, and received in, the first boom member is provided with a link secured between a second substantially fixed horizontal pivot axis on the mobile base and a third horizontal pivot axis on the second boom member whereby, when the first boom is rotated through an increasing included vertical angle, the third pivot axis on the second boom member is moved therewith longitudinally of the first boom member and away from the first horizontal axis thereby reciprocating the second boom member along a portion of the length of the first boom member to cause the distal end of the second boom member to increasingly extend beyond the first boom member.

8 Claims, 8 Drawing Figures

76
328
80
82
326
312
324
314
320
322
310
250
60
250
330
332
334
70
78
270'
240'
244'
72'
20'
280'
276'
242'
250'
310'
328'
70'
330'
39'
334'
70'
60'
260'
264
261
4.
5.
20
70
328
94
324
60
220
320
310
312
54
240
242
250
330
244
260
270
334
264'
52
262
296
280
39
74
4.
261'
96
276
270
5.
72
40
222
70
44
38
48
34

EXTENSION/ELEVATION INTRA-ACTION DEVICE FOR AERIAL LIFT APPARATUS

BACKGROUND OF THE INVENTION

This invention relates to an aerial lift apparatus having a boom assembly wherein the boom assembly comprises at least two boom members and wherein one of the boom members is secured to a mobile base and is adapted, at least, for vertically pivotable movement about a first horizontal axis with respect to the mobile base and wherin the second boom member is carried by the first boom member. A third boom member, if any, can be carried by the second boom member and a fourth boom member, if any, can be carried by the third boom member, and so on. Each of the boom members in such a lift apparatus is typically adapted to move longitudinally with respect to the boom member on which it is carried, usually by means of an extension means, such as a hydraulic cylinder or the like. However, the present invention is not limited to boom assemblies that have such separate extension means to reciprocate one boom relative to the other.

The lift apparatus of the type contemplated by this invention may be a tubular telescoping assembly having a work platform or basket on the distal end of the last, or outermost, boom member. Such a platform or basket is typically used for supporting workmen or firemen. Alternatively, the present invention may be incorporated in an assembly of ladders which are slidably disposed, one upon the other, and adapted to extend and retract, in a quasi-telescoping manner. Such a ladder assembly would typically be used on mobile firefighting trucks.

There are presently several types of telescoping and quasi-telescoping basket-carrying booms or ladders on the market. One such ladder assembly, in combination with a pumper fire truck, is disclosed in the U.S. Pat. No. 3,675,721 to Davidson et al. An extensible assembly of ladders, in combination with a truck, which assembly of ladders has a personnel-carrying basket on the distal end, is disclosed in the U.S. Pat. No. 3,572,467 to Hall.

Boom assemblies of the type discussed above are typically arranged to be carried in a retracted, generally horizontal position, usually on the top of a mobile support truck, and are pivotally mounted about a horizontal axis so that the assembly may be rotated from the horizontal position through an increasing included vertical angle with respect to the earth's surface. Most of these types of apparatus are intended to be used over a wide range of vertical angle orientations with respect to the earth's surface. Specifically, some, though not all, may be used in a substantially vertical position as well as in a horizontal, or even slightly below horizontal position.

The types of lift apparatus disclosed in the above-described patents are usually also adapted to be rotated about a vertical axis on the mobile support base or truck whereby the extended, distal end of the ladder (and personnel-carrying basket or platform, if any) may be moved in a circular path in a plane perpendicular to the vertical axis (and hence, in a circle which is generally parallel to a plane tangent to the earth's surface at that pont).

It is well known to those skilled in the art to which this invention pertains that, when the boom assembly of the lift apparatus of the type described is in a position other than in the true vertical, there is a moment created by the cantilever effect of the boom assembly which is overhanging the support base. This is especially significant when such a boom assembly is carried by a truck and when the boom assembly is rotated about a vertical axis away from alignment with the length of the truck so that the boom assembly extends outwardly to one side of the truck. The tipping moment, of force tending to overturn the support truck, as well as the structural moments imposed upon the various members, depend upon the length of the boom (in the fully extended position) and upon the weight of the boom assembly (including the weight of any platform and/or personnel at the outer end of the boom assembly).

Typically, for a given maximum design extension length and for a given boom weight (including the weight of any platform and live load associated therewith), the boom assembly base support must be appropriately designed to withstand the overturning moment. With a mobile truck support, separate retractable outriggers or struts may be provided on the truck body for extending outwardly and downwardly to contact the ground on either side of the truck to thereby increase the effective width of the support and to thereby counteract the overturning moment. Nevertheless, for a given truck and retractable strut or outrigger design, there is a maximum extended length associated with any given boom design which can be accommodated on the truck in any horizontal position without overturning the truck or exceeding allowable structural moments.

It is well known to those skilled in the art to which the present invention pertains that, as the boom assembly is lifted upwardly from a horizontal position with respect to the earth's surface, the overturning moment decreases because the effective moment arm of the boom assembly decreases. Thus, when moving a fully extended boom from the horizontal position to some elevated position, the actual height to which the boom could be further extended, without overturning the truck, increases. For example, for a given boom assembly design, a boom could have a maximum horizontal extension of, say, 76 feet at the point just below which the support truck would tend to overturn. However, in the elevated position, say at a vertical angle of 85 degrees with respect to the earth's surface, the boom could be extended an additional number of feet before the support truck would tip. If it were possible to somehow gain this "extra extension" as the boom assembly was rotated upwardly in an increasing vertical angle with respect to the earth's surface, there would be the great advantage of being able to obtain a greater reach height.

Heretofore, prior art lift apparatus of the general type to which this invention pertains, have had to take such matters into consideration and have adopted a variety of solutions, such as decreasing the boom length, decreasing the boom weight, using counterweights opposite the boom extension, and sacrificing the maximum reach height associated with a given vertical angle in order to prevent the mobile support assembly from being overturned when the boom assembly was at its fully extended, horizontal position.

The inventor of the present invention knows of no system where the boom assembly is automatically extended with an increasing included vertical angle as simply as in accordance with the present invention. It has been found to be highly desirable to provide, in a lift apparatus of the type described, means extending the boom assembly automatically and by direct mechanical linkage, as the boom assembly is rotated in an increasing included vertical angle with respect to the earth's surface so as to take advantage of the maximum reach height possible without exceeding the allowable tipping and structural moments.

SUMMARY OF THE INVENTION

The present invention provides for an improved boom assembly having a first boom member mounted for vertically pivotable rotation about a first substantially fixed horizontal axis on a mobile base. The first boom member carries at least one other boom member adapted for longitudinal movement relative thereto. The maximum extended length of the boom assembly is predetermined and is typically that length, as reduced by appropriate safety factors, beyond which the weight of the boom assembly (and any load carried thereon) would tend to overturn or overstress the mobile support structure when the boom assembly is in the horizontal position and fully extended. Though there may be a third boom member, or even more boom members, adapted to be carried by, and moved relative to, the second and subsequent boom members, the present invention effectively operates in a boom assembly having only two boom members as well as in a boom assembly having more than two boom members.

The specific boom apparatus with which the present invention is adapted to be used includes a first horizontal pivot axis on the boom assembly support means or truck at which is mounted the boom assembly for rotation in a vertical angle with respect to the earth's surface. According to the present invention, a link having first and second ends is pivotally connected at its first end to a second substantially fixed horizontal pivot axis to the base or support and is pivotally connected at its second end to the second boom member on a third horizontal pivot axis.

With the above-described novel structure, when the boom assembly is rotated into an increasing included vertical angle with respect to the earth's surface, the third pivot axis is moved therewith longitudinally of the first boom member and away from the first horizontal axis thereby reciprocating the second boom member along a portion of the length of the first boom member to cause the overall length of the boom assembly to increase.

Thus, it is seen that the combined effect of the boom assembly and the novel link which are together uniquely associated in accordance with the present invention is not merely equal to the sum of the several effects of both elements alone. Rather, the novel combination in accordance with the present invention yields a desirable and synergistic result—a result which is a substantial improvement over the prior art.

Numerous other advantages and features of the present invention will become readily apparent from the following detailed description of the invention and of one embodiment thereof, from the claims, and from the accompanying drawings.

BRIEF DESCRIPTION OF THE DRAWINGS

In the accompanying drawings forming part of the specification, and in which like numerals are employed to designate like parts throughout the same.

DESCRIPTION OF THE PREFERRED EMBODIMENT

Figures 1, 2:
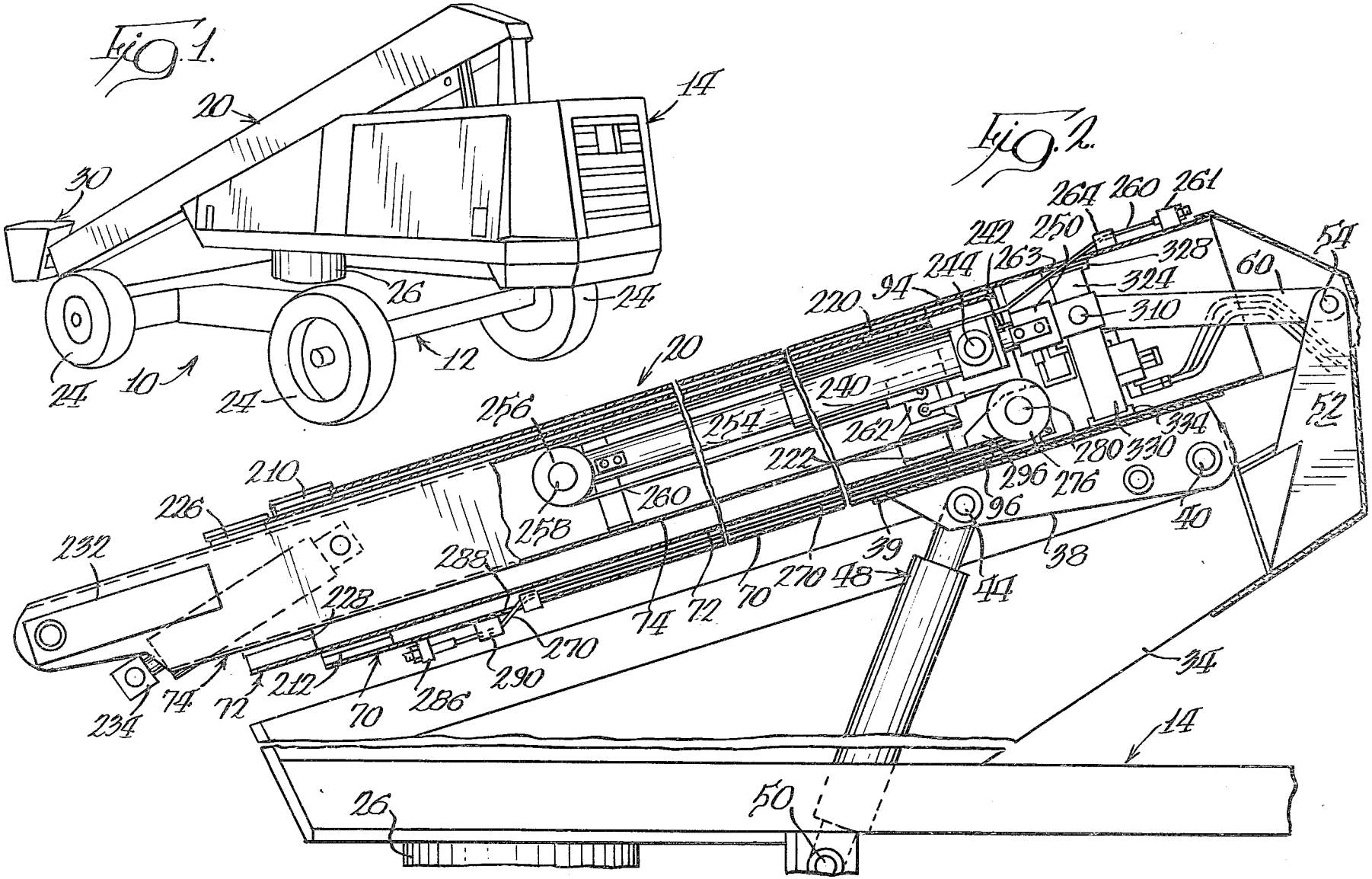
FIG. 1 is a perspective view of a mobile aerial lift incorporating the novel apparatus of the present invention.
FIG. 2 is an enlarged, fragmentary, cross-sectional view showing the boom assembly of the lift in substantially a fully retracted and lowered position and showing a portion of the supporting turntable with the cowling removed.

While this invention is susceptible of embodiment in many different forms, there is shown in the drawings and will herein be described in detail one specific embodiment, with the understanding that the present disclosure is to be considered as an exemplification of the principles of the invention and is not intended to limit the invention to the embodiment illustrated.

The precise shapes and sizes of the components herein described are not essential to the invention unless otherwise indicated, since the invention is described with only reference to an embodiment which is simple and straightforward.

It will be understood that reference made herein and in the claims to various terms such as "boom," "boom member," "axis," amd "axle," are merely illustrative. The term "boom" and "boom member" are used in their broadest sense, and are intended to include all types of members, such as telescoping tubular struts, slidably engaged ladders, and the like, all of which may be used in an aerial lift apparatus to form a generally rigid extension from the mobile support or base to an elevated region. The terms "axis" and "axle" are used herein in a non-technical sense, and are intended to include all appropriate froms of connection between pivoting, rotating, or swingable members.

For ease of description, the apparatus of this invention will be described in a normal operating position, and terms such as upper, lower, horizontal, etc., will be used with reference to this normal operating position. It will be understood, however, that the apparatus of this invention may be manufactured, stored, transported, and sold in an orientation other than the normal operation position described.

The apparatus associated with aerial lift of the type to which this invention pertains may have certain conventional drive mechanisms (e.g., double acting hydraulic cylinder extension/retraction operators) and control mechanisms, the details of which, though not fully illustrated or described, will be apparent to those having skill in the art and an understanding of the necessary functions of such mechanisms.

Referring now to the drawings, an aerial lift apparatus incorporating the present invention is illustrated in its entirety at 10 in FIG. 1. The apparatus 10 incorporates a wheeled truck assembly 12, a turret or turntable unit 14 and a boom assembly 20.

The truck 12 has four wheels 24, which wheels 24 may be driven by conventional dual hydraulic drive power hubs to provide powerful and smooth operation. The lift apparatus 10 may thus be independently driven, either when the boom assembly 20 is not being used or when the boom assembly is being operated and is supporting workmen.

The turntable unit 14 is mounted to the truck 12 on a vertical support column 26 and is adapted to rotate in a horizontal plane about the column 26 in a conventional manner. Thus, the end of the boom assembly 20 can be moved through 360 degrees of a circle.

The turntable unit 14 houses conventional hydraulic system components necessary for (1) operation of the wheels 24, (2) rotation of the turntable unit 14 per se, and (3) certain operations affecting the boom assembly 20. The turntable unit 14 also houses an appropriate engine, such as gasoline or LPG, various controls and other mechanisms well known to those skilled in the art which are necessary for proper operation of the lift apparatus.

The boom assembly 20 is mounted on its rearward end to the top of the turntable unit 14 and extends outwardly therefrom in a cantilevered fashion. The distal end of the boom assembly 20, opposite the end mounted to the turntable unit 14, preferably includes a work platform or basket 30 for supporting workmen and/or equipment.

The boom assembly 20 is adapted to be pivoted upwardly, about its rearward mounting, through an increasing included vertical angle with respect to the earth's surface. In the completely lowered position, the boom assembly 20 is preferably oriented at an angle below the horizontal so that the distal end of the boom assembly 20, and the work platform or basket 20 thereon, is located within a few feet of the earth's surface to allow workmen to climb into or out of the basket 30 at ground level.

The boom assembly 20 preferably comprises a multiple of telescoping members which are powered to extend and retract to increase the reach of the boom assembly 20. In FIG. 1, the boom assembly 20 is shown in the fully retracted and stowed position. In the extended position, the individual boom members move forwardly, away from the rearward boom assembly mounting, to extend the work basket 30. The operation of the individual boom members which comprise the boom assembly and the operation of the mechanisms for extending and retracting the individual boom members, will be explained in greater detail hereinafter. It is to be noted that the extension and retraction of the boom members is typically, and in the case illustrated, permitted independent of the angle of elevation of the boom assembly 20 with respect to the earth's surface.

The work platform or basket 30 is typically secured to the end of the boom assembly 20 through a conventional attachment structure which could include an automatic leveling system using a master/slave cylinder (not shown in FIG. 1) for maintaining the platform in proper position during the entire range of operation.

Preferably, the basket 30 contains controls, such as a joy stick type of mechanism, for effecting travel and steering of the unit and for swinging and elevating the boom assembly 20. Other controls on the operator platform or basket 30 may include controls for extending and retracting the individual boom members, hydraulic back-up systems for emergency operations, shut-down controls to stop all operations of the machine in the event of an emergency, and other function controls.

For purposes of the following description, and as used in the claims, the turntable unit 14 and the truck 12 may be regarded together as a mobile base. The actual structures making up the mobile base, such as the truck 12 and turntable 14 illustrated in the preferred embodiment of FIG. 1, are not limited in any way by the novel apparatus of the present invention which will be explained hereinafter. In fact, the present invention could be advantageously used with a boom assembly that was mounted to a fixed, non-mobile rigid platform support or base.

The apparatus of the present invention is discussed and illustrated with reference to the mobile lift apparatus 10 shown in FIG. 1 for the reason that, at this time, it is contemplated that the present invention will find most use in mobile lifts, including mobile cranes, derricks, material handling apparatus, and other such apparatus which incorporate a boom assembly vertically pivotable about a horizontal axis.

The construction of the boom assembly 20 will now be described in detail with reference to FIGS. 2, 3, and 5. As best illustrated in FIG. 2 (which shows the turntable 14 with the protective cowling removed), the boom assembly 20 is mounted at its rearward end to a boom support frame 34 of the turntable 14. The boom assembly 20 has a pair of downwardly projecting, spaced-apart, attachment plates 38. The attachment plates 38 are mounted to the boom assembly 20 via a bearing plate 39 disposed on the underside of the boom assembly 20. The attachment plates are journaled to an axle 40 (at a "first" generally horizontal pivot axis) which axis is carried by, and is substantially fixed with respect to, the turntable 14. This is the main axle about which the boom assembly 20 rotates in a substantially vertical plane with respect to the mobile base (the assembly of the truck 12 and the turntable 14).

The pair of attachment plates 38 also support an axle 44 which is journaled therein. A lift means, such as hydraulic cylinder 48 is attached on one end to the axle 44 and is secured at the other end to an axle 50 which is journaled within an appropriate support bearing on the turntable 14.

The lift means or hydraulic cylinder 48 is of a conventional type that is well known in the art and is adapted to extend and retract thereby moving the boom assembly 20 upwardly or downwardly (in a vertically pivoting rotation about the axle 40) with respect to the turntable 14.

In accordance with the present invention, the boom support frame 34 has an extension 52 at its rearward end which supports a second substantially fixed horizontal axle 54 which is journaled therein (and which axle 54 defines a "second substantially fixed horizontal pivot axis"). In accordance with the present invention, the axle 54 pivotally supports link means such as rigid link 60 on one end, which link 60 projects towards said boom assembly 20 and which link 60 is received within, and secured to, the boom assembly 20 at its other end in a manner to be described in detail hereinafter.

At this point, further details of the construction of the boom assembly 20 will be set forth. With reference to FIGS. 2 and 5, it can be seen that the boom assembly comprises a plurality of telescopically arranged boom sections or boom members, and in the specific embodiment illustrated, the boom assembly 20 includes a base boom or first boom member 70, an intermediate or second boom member 72, and a tip or third boom member 74. The boom assembly 20 can include additional sections if it is desired to increase the reach thereof.

Figure 5:
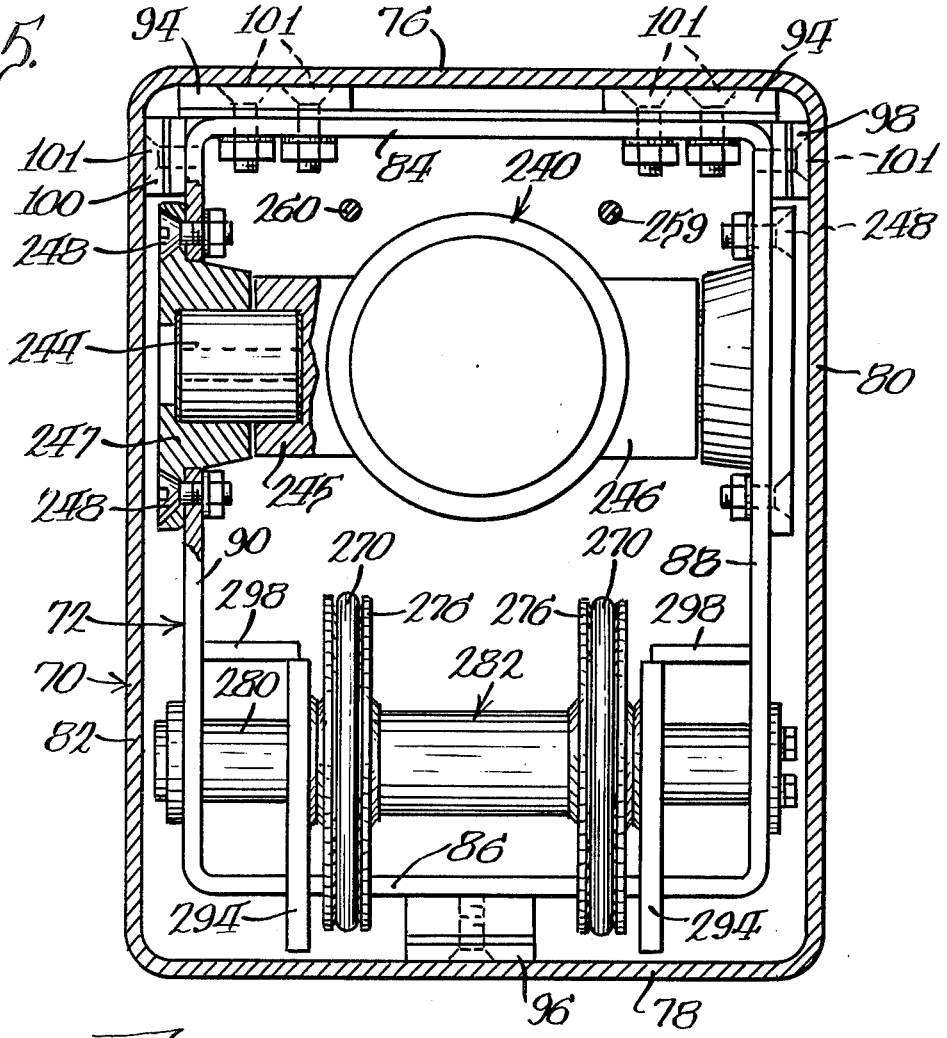
FIG. 5 is a cross-sectional view, similar to FIG. 4, but taken along the plane 5—5 of FIG. 3.

As can be best seen in FIG. 5, the first boom member 70 is a hollow rectangular member including spaced parallel top and bottom walls 76 and 78, respectively, and spaced parallel sidewalls 80 and 82. The second boom member 72 is also a hollow, generally rectangular member that includes spaced parallel top and bottom walls 84 and 86, respectively, and spaced parallel sidewalls 88 and 90.

The second boom member 72 is carried by, and is adapted to slide within, the first boom member 70. To this end, upper and lower slide pads 94 and 96, respectively, and side slide pads 98 and 100, ae secured to the outer surfaces of the second boom member 72 by means of countersunk bolts 101, or by other suitable means. The above described slide pads are secured to the second boom member at or near the rearward end thereof as illustrated in FIG. 2. Other slide pads may be secured to the second boom member 72 along the length thereof, if desired.

With reference now to FIG. 2, additional slide pads, such as pads 210 and 212, may be secured to the first boom member 70 for supporting and guiding the forward portion of the second boom member 72.

The third boom member 74 also is a hollow rectangular member similar in construction to the first and second boom members already described. The third boom is adapted to be carried by, and slide within, the second boom member 72. With reference to FIG. 2, upper and lower slide pads 220 and 222 are preferably provided between the outer surfaces of the third boom and the inner surfaces of the second boom. At the outer end of the second boom member 72, there are preferably provided additional slide pads 226 and 228 for supporting and guiding the forward portion of the third boom member 74.

The forward or outer end of the third boom member 74 supports the basket 30 (illustrated in FIG. 1, but not illustrated in FIG. 2). To this end, a pair of support bars, of which bar 232 is one, and a hydraulic cylinder leveling actuator 234, may be provided.

The second boom member 72 is adapted to extend outwardly from the first boom member 70 and the third boom member 74 is adapted to extend outwardly from the second boom member 72. To this end, a hydraulic cylinder and cable drive actuating mechanism is provided. A double acting hydraulic cylinder actuator 240 is disposed within the third boom member at the rearward end thereof. The cylinder actuator is not, however, directly mounted to the third boom member 74. Rather, the cylinder actuator 240 is mounted to the vertical sides of the second boom member 72 about a pair of horizontally disposed pins, one of such pins being designated 244 and best illustrated in FIG. 5.

Specifically, the extension cylinder actuator 240 has mounting arms 245 and 246 which project therefrom and which each receive therein one end of one of the pins 244. As shown on the left hand side of FIG. 5, the outer end of pin 244 is received in a support cap 247, which cap is anchored to the vertical sidewall 90 of the second boom member 72 by bolts, such as bolt 248. The pin 244 is journaled within both the support cap 247 and the mounting arm 245 thereby allowing the mounting arm 245 to rotate about the horizontal axis of the pin. Thus, the entire hydraulic cylinder actuator 240 can pivot about the pin 244 as required, for reasons to be explained hereinafter, as the boom assembly 20 is elevated.

The cylinder actuator 240 has a movable piston rod 242 which projects rearwardly and which is anchored to a cross member 250 which, for purposes of the present discussion, can be held in fixed relationship with the first boom member 70 as will be explained in detail hereinafter. However, for purposes of the present discussion, the cross member 250, to which the cylinder actuator rod 242 is anchored, will be assumed to be held stationary with respect to each of the three boom members 70, 72, and 74. Thus, actuation of the cylinder 240 to extend rod 242 will cause the cylinder portion to move outwardly relative to the rod.

The cylinder actuator 240 has on its forward end an extension member, such as a box beam 254, which carries a pair of spaced-apart, coaxial, parallel cable sheaves, one of which is illustrated and is designated 256 in FIG. 2. The sheaves are mounted on an axle 258 for rotation thereabout. A pair of cables, 259 and 260 illustrated in FIG. 5, are trained around the sheaves (as clearly shown in FIG. 2 for cable 260 and sheave 256) for moving the third boom member 74 outwardly relative to the second boom member 72 when the cylinder actuator 240 moves outwardly. Each cable 259 and 260 is secured or anchored at one end to the exterior of the first boom member 70 (as at lug 261). At the other end, each cable is secured to the rearward end of the third boom member 74 at a mounting bracket 262.

Each cable passes from the inside of the first boom 70 to the exterior of the first boom 70 through a slot, such as slot 263 for cable 260, in the top wall of the first boom member as illustrated in FIG. 2. Immediately exterior of the slots each cable passes adjacent a second lug, such as lug 264 for cable 260, which serve to guide the cables at that point.

When the double acting cylinder operator 240 is actuated, the box beam extension 254 is moved outwardly away from the rear of the boom assembly as the cylinder actuator slides along the piston rod 242. Since the cylinder actuator 240 is anchored to the second boom member 72 at cross pin 244, the second boom member 72 is also moved outwardly with respect to the first boom member 70. This description assumes that the rearward end of the piston rod 242, which is anchored to the cross member 250, is held in fixed relationship with respect to the first boom member 70, as will be explained in detail hereinafter.

As the cylinder actuator 240 moves outwardly from the rear of the boom assembly 20, the sheaves 256 are also carried outwardly therewith and bear against the cables 259 and 260 trained therearound. Since the cables are anchored at lugs 261, the other ends of the cables, secured to bracket 262 of the third boom member 74, are pulled forward together and pull on the third boom member 74. Owing to the fact that the cables are trained around the sheaves, a unit distance movement of the sheaves in the forward direction causes the third boom member 74 to move two units of distance in the forward direction.

Since the cylinder actuator 240 is a conventional double-acting actuator, it also can be used to retract the boom assembly 20. To this end, a second pair of cables 270 are provided, as illustrated best in FIG. 5, and are trained around sheaves 276. The sheaves 276 are mounted for rotation about a shaft or axle 280 and are maintained thereon in a spaced-apart parallel relationship by a hollow cylindrical spacer 282 which is also mounted on the shaft 280.

The axle 280 is disposed across the bottom portion of the second boom member 72 and is carried on each end by the vertical sidewalls 90 and 88, as best illustrated in FIG. 5. The sheaves 276 are prevented from moving towards the vertical sidewalls 90 and 88 by means of keeper plates 294, which have suitable apertures formed therein (not shown) through which the axle 280 passes. An upper support plate 298 is provided to connect the keeper plate 294 and vertical sidewalls 90 and 88, respectively, support plate 298 furnishing increased structural rigidity in the assembly.

The second pair of cables 270 are connected between the first boom member 70 and the third boom member 74 in a manner that is clearly illustrated for the cable 270 in FIG. 2. One end of the cable 270 is anchored to the above-described bracket 262 on the third boom member 74. The other end of the cable 270 is anchored to the exterior of the first boom member 70 near the forward end of the boom member 70 at the lug 286.

Each cable 270 passes from the interior of the first boom member 70 to the exterior of the first boom member 70 through a slot, such as slot 288, in the lower wall of the first boom member 70. Immediately exterior of the slots, the cables pass adjacent a second lug 290, which acts to guide the cables at that point.

During retraction of the boom assembly 20, the operation of the double-acting cylinder actuator 240 is reversed so that the cylinder effectively slides rearwardly along the anchored piston rod 242, thereby carrying with it the second boom member 72. It is to be remembered that the cylinder actuator 240 is fixed to the second boom member 72 through pins 244. Thus, any movement of the cylinder actuator is necessarily transmitted to the second boom member 72. As the second boom member 72 is moved rearwardly by the cylinder actuator 240, the sheaves 276 are carried therewith and act to pull on the cables 270, which are entrained therearound. The cables, being anchored to the first boom member 70 at lug 286 move along the sheaves 276 and thus pull the third boom member 74 therewith.

As in the case of the first pair of extension cables, the second pair of cables 270 must move through a distance equal to twice that of the second boom member 72 whenever the second boom member is moved a given amount by the cylinder actuator 240. Thus, when the boom assembly is retracted, the third boom member 74 retracts at a rate twice as great as that of the second boom member 72.

The above-described double-acting hydraulic cylinder actuator and extension and retraction cable assembly could be replaced by any other suitable "coupling means" for connecting the second and third boom members together, wherein the second and third boom members can be moved relative to the first boom member, and if desired, wherein movement of the second and third boom members longitudinally relative to each other is permitted or effected. Such suitable means could include chain drives instead of the extension and retraction cables and could include, in place of the cables, additional separate hydraulic or pneumatic or electric actuators.

As will be explained in detail below, according to the present invention, the second boom member 72 can be automatically, by direct mechanical linkage, extended by an increasing but predetermined amount as the boom assembly 20 is rotated in a vertical plane about the horizontal pivot axle 40. Conversely, according to the present invention, the second boom member 72 is automatically retracted by an increasing but predetermined amount when the boom member is lowered or rotated downwardly about the horizontal pivot axle 40.

In accordance with the present invention, the previously described link 60, which is pivotally mounted about axle 54 to extension member 50 of turntable 14, is secured on one end to the second boom member 72. In FIG. 2, it is seen that this connection between the link 60 and the second boom member 72 is indirectly effected through a number of intervening structural elements. Specifically, the link member 60 is pivotably secured on its forward end to a horizontal axle 310 (which axle 310 defines a "third horizontal pivot axis") as best illustrated in FIGS. 3 and 4. The axle 310 is journaled within a pair of mounting blocks 312 and 314, which blocks are secured to, and project rearwardly from the generally horizontal cross member 250, which cross member 250 is in turn secured to the previously described cylinder actuator piston rod 242.

Figures 3, 4:
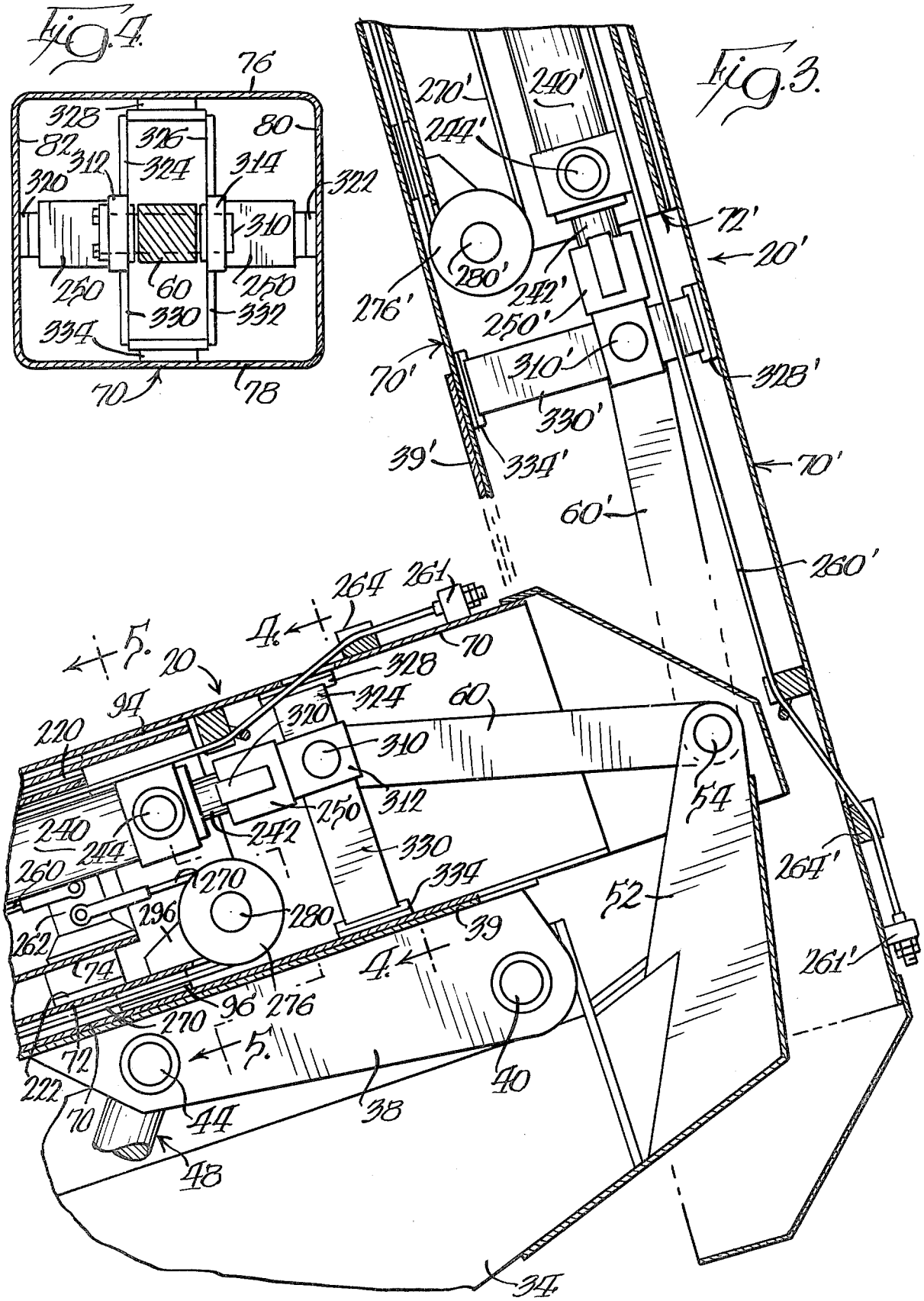
FIG. 3 is a still further enlarged, fragmentary, sectional view of the rear end of the boom assembly where it is connected to the supporting turntable, the assembly being shown in a first lowered position and in a second elevated position.
FIG. 4 is a cross-sectional view taken generally along the plane 4—4 of FIG. 3.

As best illustrated in FIG. 4, the cross member 250 has on one end a side pad 320 in contact with the inner surface of vertical sidewall 82 of the first boom member 70 and has on the other end a slide pad 322 in contact with the inner surface of the vertical sidewall 80 of the first boom member 70.

As best illustrated in FIG. 4, projecting upwardly from the mounting blocks 312 and 314 are, respectively, slide pad support blocks 324 and 326 which hold a slide pad 328 in contact with the inner surface of the upper wall 76 of the first boom member 70. Secured to, and projecting downwardly from, the mounting blocks 312 and 314 are, respectively, support blocks 330 and 332 which hold a slide pad 334 in contact with the inner surface of the bottom wall 78 of the first boom member 70. The inner surfaces of the top, bottom, and sidewalls, walls 76, 78, and 80 and 82, respectively, function as bearing surfaces along a portion of the length of the first boom member 70 and are adapted to be engaged by the slide pads disposed between the link 60 and the cylinder actuator piston rod 242.

The above described slide pads and supporting structures adjacent the end of the link 60 comprise a guide means for guiding the end of the link 60 along the first boom member 70 during reciprocating movement relative to the first boom member when the boom assembly 20 is elevated about the horizontal axle 40 as will next be explained.

FIG. 3, showing the rearward end of the boom assembly 20, illustrates the elevation of the boom assembly 20 as it is rotated about the horizontal axle 40 between a lower first portion having an included angle of about 18° below the horizontal with respect to the earth's surface and an elevated second position having an included angle of about 75° with respect to the earth's surface. The elements of the boom assembly 20 in the elevated second position are indicated by primed reference numerals corresponding to the unprimed reference numerals used for the boom assembly elements in the lower first position. It can be seen that as the boom assembly 20 rotates in a clockwise direction about the axis 40, the first boom member 70 is moved over the substantially fixed horizontal pivot axle 54 of the link 60. Since the link 60 is a substantially rigid and hence, incompressible member, the distance between its pivotable connection at axle 54 and its pivotal connection at axle 310 remains constant. Consequently, the first boom member 70 and the slide pads 328 and 334 respectively slide with respect to each other. Thus, the first boom member 70 is seemingly retracted relative to the axle 310. Since the axle 310 is essentially secured to the second boom member 70 (via the structural elements comprising the mounting blocks 312 and 314, the cross member 250, the cylinder actuator piston rod 242, and the cylinder pin or axle connection 244), the second boom member 72 (and the third boom member 74 carried thereon) effectively extends out from the first boom member 70.

The elevated position of the boom assembly 20' illustrated in FIG. 3 shows how the pivot axle 310 of the forward end of link 60 has effectively moved a substantial distance away (upwardly) from the boom assembly pivot axle 40. In the embodiment illustrated, owing to the specific coupling means (the cylinder operator 240 and retraction/extension cable system), the third boom member 74 is also moved outwardly relative to the second boom member 72 as the boom assembly 20 pivots from the lower first position to an elevated second position. This is because the cables 260 are secured on one end to the first boom member 70 and are thus pulled rearwardly with respect to the link axle 310 as the boom assembly 20 is elevated. It should be pointed out that if other means were used to couple the second and third boom members together, and if such other members were not secured to the first boom member, then the third boom member would not necessarily extend relative to the second boom member during the rotation of the boom assembly 20 to an elevated position.

It should also be pointed out that the link 60, though shown connected to the second boom member 72 through a number of rigid structural elements, could be directly attached to the intermediate boom through a pivotable connection. For purposes of describing the present invention, the link 60 may be considered as being connected to the second boom member 72 when that is viewed as comprising the extension means and the guide means. Thus, connecting the link 60 to the guide means or slide pad structure as illustrated in the preferred embodiment is in effect the same as directly connecting the link with the second boom member 72. However, it should be noted that the guide means is not necessary for operation of the apparatus of the present invention. Specifically, link 60 could be directly connected by pivot axle 310 to the rearward end of the hydraulic cylinder actuator 242. However, with large aerial lift apparatus of the type illustrated herein, and where relatively large movements are experienced, providing the above-described guide means is a novel approach to accommodating the various developed loads.

Figure 6B:
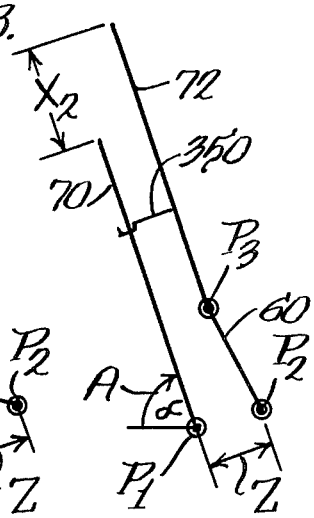
FIG. 6B is a schematic diagram similar to FIG. 6A but showing the boom assembly rotated from the horozintal position of FIG. 6A through an increasing included vertical angle to an elevated second position.
Figure 6A:
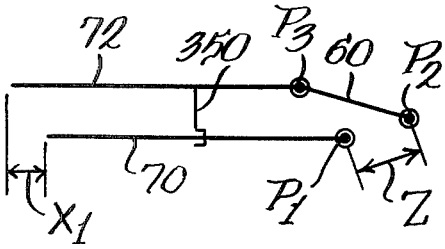
FIG. 6A is a schematic diagram of the boom assembly in a substantially horizontal position.

FIGS. 6A and 6B are simplified, schematic representations of the boom assembly and support structure illustrated in FIG. 3. The slide pad guide means between the first and second boom members 70 and 72, respectively, is illustrated by line 350 in FIGS. 6A and 6B. For purposes of clarity, the third boom member 74 is not shown in schematic FIGS. 6A and 6B. FIG. 6A represents the lower first position of the boom assembly and FIG. 6B represents an elevated second position of the boom assembly. In the lower first position illustrated in FIG. 6A, it can be seen that the second boom 72 extends a distance $X_1$ beyond the first boom member 70. As the boom assembly is rotated in a clockwise direction about the first substantially fixed horizontal pivot axis $P_1$ (corresponding to axle 40 in FIG. 3), the second boom member 72 is carried therewith.

As the boom member 70 is rotated in a clockwise direction about the first horizontal pivot axis (axle 40 in FIG. 3) to an increasing vertical angle $\alpha$ in the direction of arrow A, the second boom member 72 is carried therewith and, owing to the rigid link 60 pivotally mounted between the second substantially fixed horizontal pivot axis $P_2$ (corresponding to axle 54 in FIG. 3) and the third horizontal pivot axis $P_3$ (corresponding to the axle 310 in FIG. 3), the second boom member 72 is forced outwardly along the first boom member 70. In the elevated second position the second boom member 72 is seen to extend beyond the end of the first boom member 70 by a distance $X_2$ which is greater than the horizontal extension distance $X_1$ shown in FIG. 6A.

In the converse of the boom assembly elevation operation described immediately above, the boom assembly is lowered from the elevated position towards a horizontal or lower position. As that occurs, the second boom 72 retracts relative to the first boom member 70 thereby reducing the overall effective length of the the boom assembly as the boom assembly is lowered.

The location of the second substantially fixed horizontal pivot axis $P_2$ illustrated in FIGS. 6A and 6B is shown to the right of, and somewhat above, the first substantially fixed horizontal pivot axis $P_1$. This relative location is not critical to the proper operation of the invention and may be varied. However, depending on the length of the link 60 and upon the location of the second substantially fixed horizontal pivot axis $P_2$, the maximum vertical angle to which the boom can be elevated might be limited. With appropriate structural design, it would be possible to locate the second substantially fixed horizontal pivot axis $P_2$ to the left of the first substantially fixed horizontal pivot axis $P_1$ and either above or below axis $P_1$.

Figure 7:
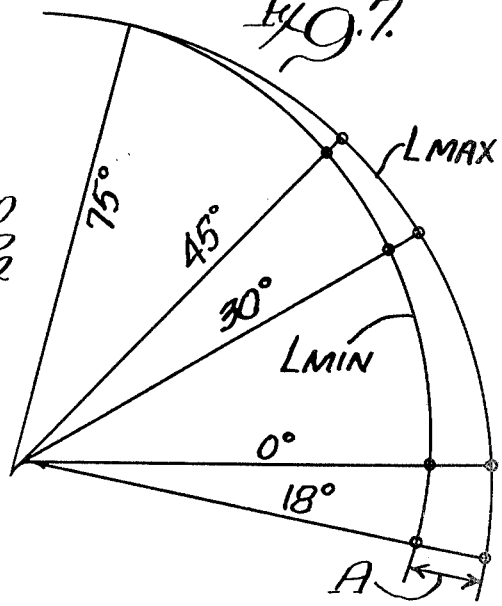
FIG. 7 is a diagram showing how the relative extension of the boom assembly varies with rotation of the boom assembly through an increasing included vertical angle.

FIG. 7 illustrates graphically how the boom assembly is automatically, by direct mechanical linkage through link 60, extended or retracted a distance A between a lower first position and elevated second positions. The maximum length of the boom assembly, occurring at the highest elevated position, is indicated by the outer arc $L_{MAX}$. As the boom assembly is lowered, the effective length is reduced so that the distal end of the boom assembly traces a curve indicated by the inner arc $L_{MIN}$ so that in the lowermost position, the effective length of the boom assembly has been reduced from the maximum length $L_{MAX}$ by the distance designated A.

It is seen that the novel combination of a boom assembly and the link mechanism effects a synergistic and beneficial result whereby the boom assembly is automatically extended as the boom is raised from a minimum to a maximum elevation and, conversely, is retracted as the boom assembly is lowered. This feature allows greater boom overlap and lower slide pad loads where it is most beneficial (e.g., in a generally horizontal boom position). Further, this feature shortens the available maximum reach at the horizontal (ground level) and therefore reduces tipping and structural moments. Additionally, this novel design allows a reduction of the overall lift apparatus weight and of the counterweight that is typically provided in lift apparatus of this type.

I claim:

1. In an aerial lift apparatus adapted to be supported upon a generally horizontal plane with respect to the earth's surface and having a mobile base and a boom assembly carried thereon and vertically pivotable with respect to said base, said boom assembly including a vertically pivotable first elongate boom member mounted about a first substantially fixed horizontal pivot axis on said mobile base and adapted for pivoting through an increasing included vertical angle with respect to said base and a second elongate boom member carried by, and guided for reciprocable movement relative to, said first boom member, and means for pivoting said boom assembly about said first axis, the improvement comprising:

a fixed-length link having first and second ends, said link pivotably connected at said first end about a second substantially fixed horizontal pivot axis to said base;

an extension means for independently moving said second boom member relative to said first boom member, said extension means connected between said second boom member and said link and pivotably connected at said second end of said link about a third horizontal pivot axis; and a guide means adjacent said second link end and connected with said extension means for guiding said second link end along said first boom member during reciprocating movement relative to said first boom member whereby, when said boom assembly is pivoted about said first axis into an increasing included vertical angle with respect to said base, said third axis is moved therewith longitudinally of said first boom member and away from said first axis thereby reciprocating said second boom member along a portion of the length of said first boom member to cause the overall length of the boom assembly to increase, and when said boom assembly is pivoted about said first axis into a decreasing included vertical angle, the overall length of the boom assembly decreases.

2. The apparatus in accordance with claim 1 in which said guide means includes a slide means adapted to contact said first boom member.

3. The apparatus in accordance with claim 1 in which said boom assembly is a telescoping boom assembly and said second boom member is received in at least a portion of said first boom member and is adapted to telescope with respect thereto.

4. In an aerial lift apparatus having a base and a vertically pivotable boom assembly carried thereon, said boom assembly having a vertically pivotable first elongate boom member mounted about a first substantially fixed horizontal pivot means on said base and a second elongate boom member carried by, and guided for reciprocable movement relative to, said first boom member, the improvement comprising:

a second substantially fixed horizontal pivot means on said base spaced from and parallel to said first horizontal pivot means;

a third horizontal pivot means on one end of said second boom member; and a fixed-length link having first and second ends, said link pivotably connected at said first end to said second horizontal pivot means;

said second boom member including a boom extension piston and cylinder actuator with the piston of the actuator connected with said link second end through said third pivot means and with the cylinder of the actuator connected directly to said second boom member adjacent one end of said second boom member, said second boom member including a guide means adjacent said second link end for guiding said second link end along said first boom member during reciprocating movement relative to said first boom member whereby, when said boom assembly is rotated about said first horizontal pivot means from a lowered first position to an elevated second position, said third pivot means on said second end of said link is moved therewith longitudinally of said first boom member away from said first horizontal pivot means thereby reciprocating said second boom member along a portion of the length of said first boom member to cause the overall length of the boom assembly to increase from a shorter length to a longer length, and when said boom assembly is rotated about said first pivot means from the elevated second position to the lowered first position, the overall length of the boom assembly decreases by direct mechanical linkage.

5. The apparatus in accordance with claim 4 in which said first boom member has a first bearing surface along a portion of its length and in which said guide means comprises a generally rigid member pivotably mounted about said third pivot means and adapted to engage said first bearing surface on said first boom member.

6. The apparatus in accordance with claim 5 in which said boom assembly has a third boom member, said boom assembly being adapted to telescopingly extend and retract with said second boom member being received in at least a portion of said first boom member and with said third boom member being received in at least a portion of said second boom member; in which said boom assembly further has coupling means connecting said second and third boom members for effecting longitudinal movement of said second and third boom members relative to said first boom member when said boom assembly is rotated about said first pivot means; and in which said means for pivoting said boom assembly comprises a fourth pivot means on said base, a fifth pivot means on said first boom member, and lift means secured between said fourth and fifth pivot means.

7. In an aerial lift apparatus adapted to be supported upon a generally horizontal plane with respect to the earth's surface and having a mobile base and a boom assembly carried thereon and vertically pivotable with respect to said base, said boom assembly including a vertically pivotable first elongate hollow boom member mounted about a first substantially fixed horizontal pivot axis on said mobile base and adapted for pivoting through an increasing included vertical angle with respect to said base and a second elongate boom member carried by, and guided for reciprocable movement relative to, said first boom member, and means for pivoting said boom assembly about said first axis, the improvement comprising:

a fixed-length link at least partially disposed within said first elongate hollow boom member having first and second ends, said link pivotably connected at said first end about a second substantially fixed horizontal pivot axis to said base and pivotably connected at said second end to said second boom member within said first elongate hollow boom member about a third horizontal pivot axis whereby, when said boom assembly is pivoted about said first axis into an increasing included vertical angle with respect to said base, said third axis is moved therewith longitudinally of said first boom member and away from said first axis thereby reciprocating said second boom member along a portion of the length of said first boom member to cause the overall length of the boom assembly to increase, and when said boom assembly is pivoted about said first axis into a decreasing included vertical angle, the overall length of the boom assembly decreases.

8. In an aerial lift apparatus adapted to be supported upon a generally horizontal plane with respect to the earth's surface and having a mobile base and a boom assembly carried thereon and vertically pivotable with respect to said base, said boom assembly including a vertically pivotable first elongate boom member mounted about a first substantially fixed horizontal pivot axis on said mobile base and adapted for pivoting through an increasing included vertical angle with respect to said base and a second elongate boom member carried by, and guided for reciprocable movement relative to, said first boom member, and means for pivoting said boom assembly about said first axis, the improvement comprising:

a fixed-length link having first and second ends, said link pivotably connected at said first end about a second substantially fixed horizontal pivot axis to said base; and an extension means for independently moving said second boom member relative to said first boom member, said extension means connected to the inner end of said second boom member between said second boom member and said link and pivotably connected at said second end of said link about a third horizontal pivot axis whereby, when said boom assembly is pivoted about said first axis into an increasing included vertical angle with respect to said base, said third axis is moved therewith longitudinally of said first boom member and away from said first axis thereby reciprocating said second boom member along a portion of the length of said first boom member to cause the overall length of the boom assembly to increase, and when said boom assembly is pivoted about said first axis into a decreasing included vertical angle, the overall length of the boom assembly decreases.

* * * * *